US007857492B2

(12) United States Patent
Dixon

(10) Patent No.: US 7,857,492 B2
(45) Date of Patent: Dec. 28, 2010

(54) LUMINAIRE WITH A HOUSING AND AN ADJUSTABLE SPOTLIGHT

(75) Inventor: Rod Dixon, Newton Aycliffe (GB)

(73) Assignee: Zumtobel Lighting GmbH & Co. KG (DE)

( * ) Notice: Subject to any disclaimer, the term of this patent is extended or adjusted under 35 U.S.C. 154(b) by 691 days.

(21) Appl. No.: 11/572,964

(22) PCT Filed: Aug. 5, 2005

(86) PCT No.: PCT/EP2005/008538

§ 371 (c)(1),
(2), (4) Date: Dec. 5, 2007

(87) PCT Pub. No.: WO2006/015821

PCT Pub. Date: Feb. 16, 2006

(65) Prior Publication Data

US 2008/0247181 A1 Oct. 9, 2008

(30) Foreign Application Priority Data

Aug. 6, 2004 (DE) ..... 10 2004 038 599

(51) Int. Cl.
*B60Q 1/06* (2006.01)

(52) U.S. Cl. ..... 362/428; 362/419; 362/365; 362/366; 362/289; 362/287

(58) Field of Classification Search ..... 362/428, 362/419, 365, 366, 427, 418, 285, 289, 287
See application file for complete search history.

(56) References Cited

U.S. PATENT DOCUMENTS

| | | | | |
|---|---|---|---|---|
| 4,821,162 | A | 4/1989 | Ellis | |
| 5,029,794 | A * | 7/1991 | Wolfe | 248/343 |
| 5,291,381 | A | 3/1994 | Price | |
| 6,036,337 | A * | 3/2000 | Belfer | 362/287 |
| 6,964,490 | B2 * | 11/2005 | Scholz | 362/33 |
| 2005/0047142 | A1 * | 3/2005 | Lui | 362/275 |

FOREIGN PATENT DOCUMENTS

| | | | |
|---|---|---|---|
| DE | 8812850 | U1 | 12/1988 |
| DE | 19744638 | A1 | 4/1999 |

OTHER PUBLICATIONS

International Search Report as issued by European Patent Office on Nov. 28, 2005 in connection with PCT/EP2005/008538.

* cited by examiner

*Primary Examiner*—Sandra L O Shea
*Assistant Examiner*—Jessica L McMillan
(74) *Attorney, Agent, or Firm*—The H.T. Than Law Group

(57) ABSTRACT

The invention relates to a luminaire (1) having a luminaire housing (2) and an adjustable spotlight arrangement (10). In order to achieve a movement of the spotlight arrangement (10) which is dependent in two degrees of freedom on one another, the spotlight arrangement (10) is held displaceably in a displacement direction (5*b*) of the luminaire housing (2), and there is provided in the luminaire housing (2) a pivot guide slot member (14), by means of which upon displacement in the displacement direction the spotlight arrangement (10) is compulsorily and reproducibly pivoted.

16 Claims, 7 Drawing Sheets

LUMINAIRE WITH A HOUSING AND AN ADJUSTABLE SPOTLIGHT

FIELD OF THE INVENTION

The invention refers to a luminaire according to the preamble of claim 1.

It is possible with a luminaire of this kind to adjust the adjustable spotlight so that the main direction of emission is turned towards a certain part region of the available adjustment range. It is thus possible to illuminate primarily only this part region. Such a luminaire is therefore suited for emphasizing by illumination the part region in the room present e.g. for decorative reasons or to illuminate objects in the part region, e.g. a picture or a device or an information sign, and improve the visibility thereof. A luminaire of this kind is thus also excellently suited for a showroom or a gallery or a museum to emphasize optically by illumination at least one object arranged in the associated part region.

BACKGROUND OF THE INVENTION

From DE 197 44 638 A1 there can be understood a luminaire with an adjustable spotlight, which has a housing, which is connected with a holder means by such a joint arrangement that the housing forming the spotlight is adjustable into individual pivoted positions of a movement plane.

Although with this previously known luminaire adjusting the spotlight is possible, and this into individually selectable positions, a difficulty can however be seen because the operating person must manually bring about the desired position. In addition, this luminaire is formed without a luminaire housing, through which lever linkages present are freely visible.

SUMMARY OF THE INVENTION

The invention has the object of so configuring a luminaire of the kind indicated in the introduction so that dependent movement of the spotlight in two degrees of freedom is achieved and preferably also that an arrangement of the mechanics making possible the adjustability of the spotlight arrangement which is protected at least on multiple sides is achieved.

This object is achieved by the features of the claim 1. Advantageous further developments of the inventions are described in the dependent claims.

With the luminaire according to the invention the spotlight is held displaceable in a straight-line displacement direction of the luminaire housing, wherein a first pivot guide slot member is located on the luminaire housing, by means of which upon moving in the displacement direction the spotlight is compulsorily and reproducibly pivoted. Through this not only is a selective adjustment of the spotlight in the displacement direction possible but there is also achieved at the same time a compulsorily controlled pivot movement of the spotlight. Since the movement in the displacement direction is effected in a guide slot member, there is consequently provided both for the displacement movement and for the pivot movement of the spotlight a compulsory guidance. The operating person needs therefore only to move the spotlight in the displacement direction, whereby the spotlight is at the same time pivoted. The displacement direction and the size of the pivot movement can thereby be selectively determined by the design of the guide slot member.

As a guide for the displacement movement a displacement guide slot member which includes an acute angle with the pivot guide slot member can be provided.

Thereby, the luminaire can be so constructed that in a middle position of the displacement range the spotlight is in a middle position of its pivot range, and with displacement movements going beyond the middle range in each case a pivot movement is attained oppositely directed to the previous pivot movement.

By means of a pivot movement relative to the carrier of the spotlight (with its carrier) directed transversely to the above-described first pivot movement of the spotlight, the illumination area can be enlarged or shifted also to the side.

Features which make a selective pivot movement of the spotlight possible in a second pivot plane, which is at right angles to the first displacement plane containing the displacement direction, are contained in further dependent claims. This configuration makes it possible, with reference to the displacement plane, to illuminate offset areas to the side of the room present, wherein these areas are compulsorily reached and set by means of a displacement in the displacement direction.

Below, advantageous configurations of the invention are explained in more detail with reference to a preferred exemplary embodiment and the drawings. There is shown:

DETAILED DESCRIPTION OF THE INVENTION

Figure 4:
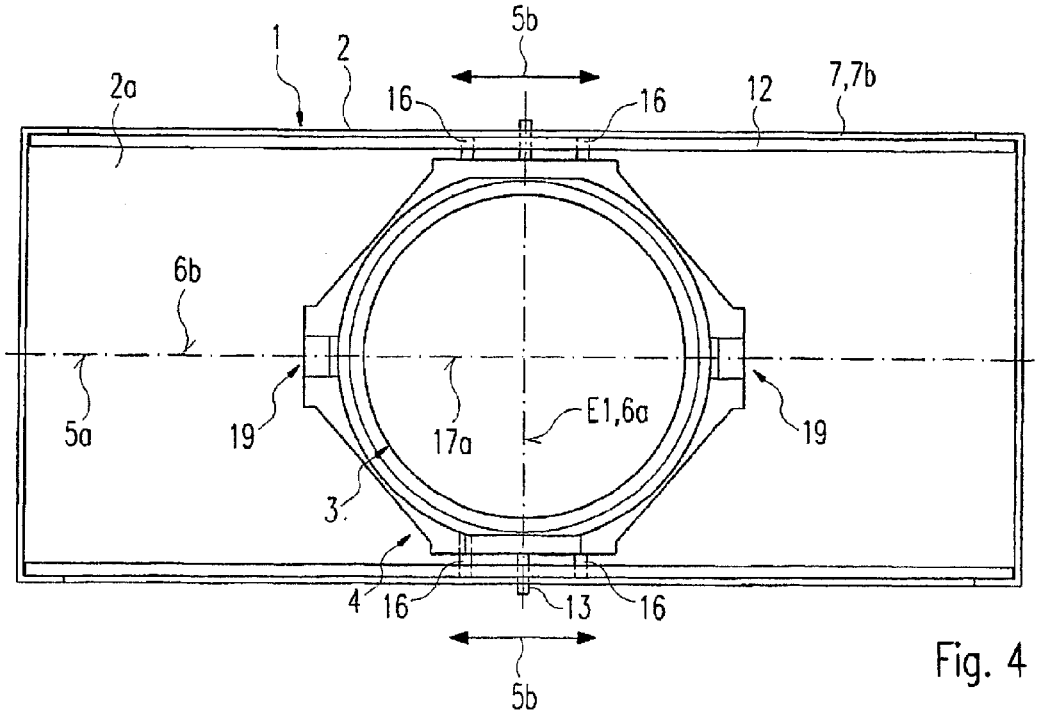
FIG. 4 the luminaire in a view from below.

The main components of the luminaire designated as a whole by 1 are a luminaire housing 2, a spotlight 3, a carrier 4 for the spotlight 3, a displacement mechanism 5 through which the carrier 4 is displaceably connected in a displacement plane 5*a* (FIG. 4) with the housing 2 or extension parts of the same, and a first pivoting mechanism 6 (FIG. 5) through which the carrier 4 is pivotable back and forth around a pivot axis 6*a* which extends approximately at right angles to the displacement plane 5*a* or in parallel thereto. An adjusting device containing the displacement mechanism 5 and the pivoting mechanism 6 is designated as a whole by 7. The carrier 4 and the spotlight 3 form a spotlight arrangement 10 displaceable as a movement unit in the displacement plane and pivotable.

The housing 2 is formed pot-shaped with a base wall 2*a* and a peripheral wall 2*b* so that it has an open housing side, the opening of which is designated by 2*c*. The displacement mechanism 5 and the pivoting mechanism 6 are at least partly located in the hollow space of the housing 2, whereby they are at least partly covered at the side by the peripheral wall 2*b*. In the exemplary embodiment the housing 2 has a cuboid-like form with a substantially flat base wall 2*a* preferably of quadrilateral form, from the edges of which four side walls project, of which in each case two mutually oppositely lying side walls are designated by 7 or 8.

The side walls may be of different length. In the exemplary embodiment there are provided two broad-side side walls 7 which extend to two sides and parallel to the displacement plane 5*a*, and two narrow-side side walls 8 which extend at right-angles to the displacement plane 5*a*.

The housing 2 has at least one non-illustrated fastening element, e.g. a hole in the housing wall through which the housing 2 can be screwed together with the ceiling or wall by means of at least one screw.

The displacement mechanism 5 has at least one guide slot member 9, in which the carrier 4 is selectively movable back and forth in the displacement plane 5*a*, preferably in a straight line and in particular approximately parallel to the base wall 2*a*. The guide slot member 9 is formed by an e.g. continuous first guide groove 11 in a guide wall 12, wherein the carrier 4 is mounted movably longitudinally back and forth with a guide pin 13 in the guide groove 11 and is secured against a transversely directed slipping out of the guide groove 11. In the exemplary embodiment there are present two guide walls 12, e.g. forming the broad-side side walls 7, each with a first guide groove 11, which are arranged mutually oppositely lying and between which the carrier 4 is mounted with two displacement guide pins 13 at the side arranged mutually oppositely lying. The guide pin or guide pins 13 are circular in the cross-section so that the carrier 4 is not only movable longitudinally of the displacement direction 5*b* but also is pivotable back and forth in the displacement plane 5*a*.

The compulsorily effective first pivoting mechanism 6 is so associated with the displacement mechanism 5 that upon a displacement of the carrier 4 this compulsorily and at the same time carries out a pivot movement around the pivot axis 6*a* which extends at right angles to the displacement plane 5*a* and extends axially through the displacement guide pin 13.

The first pivoting mechanism 6 may be formed by at least a second guide slot member 14, which is likewise is formed by a guide groove 15 in the guide wall 12 and extends parallel to pivot plane 6*b* of the carrier 4 corresponding to the displacement plane 5*a* and thereby has a preferably constantly varying effective spacing from the first guide slot member 9 and into which the carrier 4 engages with a second guide pin 16 having a circular cross-sectional form. The second guide slot member 14 may thereby develop in a straight line or in an arc shape. In the first case the angle of inclination included between the guide slot members 9, 14 is equal to W1. In the second case it can continuously increase or decrease itself.

The maximum spacing a is smaller than the spacing b between the two guide pins 13, 16, through which the carrier 4 always stands at an angle with reference to the guide grooves 11, 15 and a dead point disposition for the carrier 4 is prevented.

When moving in the guide slot members 9, 14 between the ends thereof the carrier 4 is consequently pivoted between a minimum pivot position (see position of the carrier 4 in solid lines in FIG. 7) and a maximum (FIG. 5) pivot position movement. The first guide slot member 9 develops approximately parallel to the base wall 2*a* in the exemplary embodiment.

Figure 5:
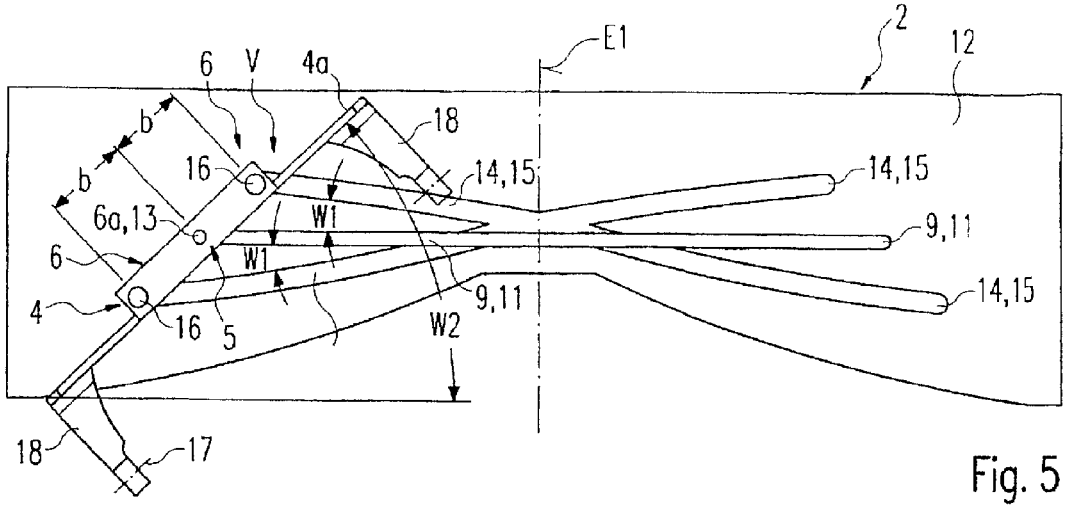
FIG. 5 a displacement and pivoting mechanism of the luminaire in a left displacement and pivot end position.
Figure 6:
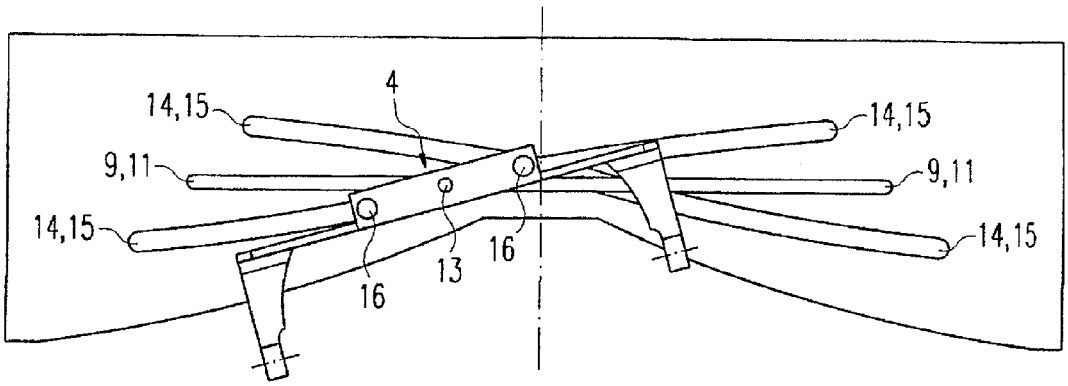
FIG. 6 the mechanism in an intermediate position displaced in direction towards the other displacement and pivot end position.
Figure 7:
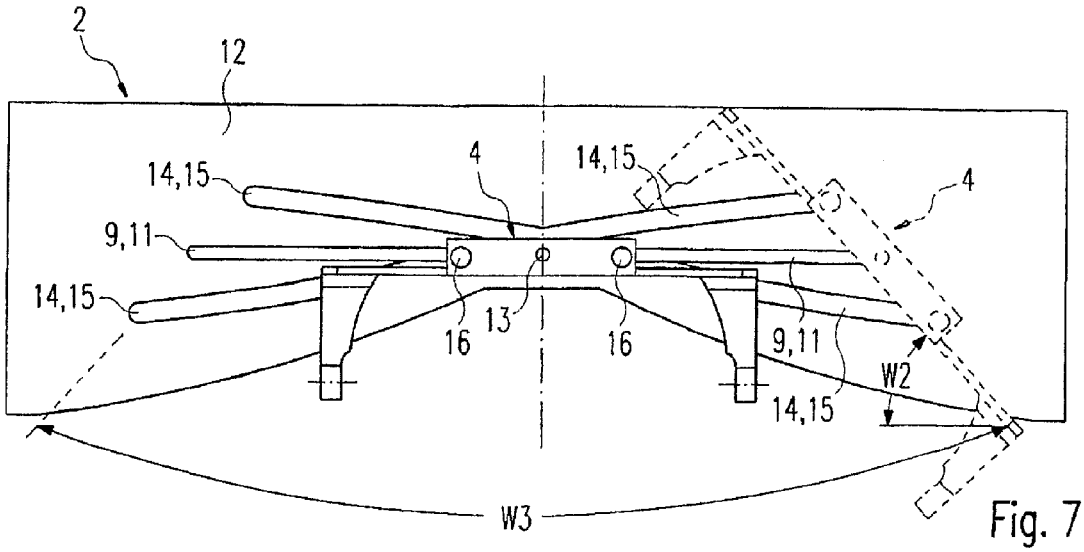
FIG. 7 the mechanism in its middle position of the displacement and pivoting range.

With the displacement into the end position to the left in accordance with FIG. 5 the carrier 4 with the spotlight 3 is so pivoted that with reference to its above-described position in FIG. 7 the carrier 4 includes an acute angle W2, which e.g. may be 45°.

To stabilize the pivoting mechanism 6 it is advantageous to provide in each case two second guide slot members 14 or guide grooves 15 on the two sides of the first guide slot member 9, here above and below the guide slot member 9. In this case there are arranged on the carrier 4 two second guide pins 16 in each case at a double spacing b from one another so that both guide pins 16 enter into the guide grooves 15 and are guided therein.

For enlargement of the pivoting range of the carrier 4 it is advantageous to extend the first guide slot member 9 and the second guide slot members 14 beyond the associated middle plane, in particular mirror symmetrically, so that there arises an X-form development. Upon a displacement of the carrier 4 beyond this middle region the carrier 4 can be pivoted with the spotlight 3 in the opposite pivot movement direction, so that the overall attainable pivot movement angle W3 may be larger, e.g. twice as large, as W2, whereby the spotlight 3 is in each case directed to the side of the luminaire, which is directed opposite to the outwardly directed displacement direction 5*b*. The opposite, right, pivot movement position of the carrier 4 in FIG. 7 is indicated by broken lines.

Within the scope of the invention the two guide grooves 15 or the three guide grooves 11, 15 may transition into one another in the region of their minimum spacing a such that the guide pins 16 or 13 and 16 lie behind each other in the displacement direction 5*b*, whereby the carrier 4 is with its side for mounting for the spotlight 3, e.g. for a ceiling fastening, directed downwardly.

If the guide grooves 11, 15 transition into one another, they form a quasi junction. By e.g. manual turning or guiding the second guide pins 16 can be led respectively into the associated upper or lower guide groove branch.

Through different depth of the guide grooves 11, 15 it can be prevented that the guide pins 13, 16 enter into the respective not associated guide groove 11, 15. In the exemplary embodiment the depth of the second guide groove 15 corresponds only to a part of the thickness of the guide wall 12, so that this guide part is covered from the outside.

To be able to pivot the spotlight 3 also transversely to the displacement plane 5 and to be able to illuminate areas to the side thereof the spotlight 3 is pivotably connected with the carrier 4 around a pivot axis 17*a* by means of a second pivoting mechanism 17, the pivot axis 17*a* preferably running in the displacement plane 5*a* or parallel thereto or may include an acute angle (not illustrated) with the displacement plane 5*a*.

The pivoting mechanism 17 or the carrier 4 may e.g. have two fork arms 18 having a spacing e, directed longitudinally of the displacement plane 5*a*, from each other, with which fork arms the spotlight 3 is connected pivotably around the pivot axis 17*a*, e.g. in that the fork arms 18 engage over the spotlight 3 and between the spotlight 3 and the fork arm ends rotary bearings 19 are provided. These may e.g. be formed by joint pins 19*a* projecting radially from the spotlight 3, which are mounted rotatably in bearing sleeves 19*b* arranged on the carrier 4. To be able to offer sufficient space for the pivoting of the spotlight 3 the rotary bearings 19 are arranged in the end region of the fork arms 18, which project from an e.g. flat base part 4*a* of the carrier 4 towards the side away from the base wall 2*a*. In order further to achieve a small construction the base part 4*a* has a recess 4*b*, into which the spotlight 3 can freely enter in the case of an appropriately large pivot movement.

The displacement mechanism 5 and the pivoting mechanism 6 are formed such that at least in the illustrated pivot end positions the carrier 4 and the spotlight 6 are located in the hollow space of the luminaire housing 2, thus below the base wall 2*a*. Through this a low-profile construction of the luminaire 1 is ensured.

It is advantageous for the stabilization of the guide edges of the first guide grooves 11, formed preferably as continuous slots, to provide edge extensions 11*a* on the edges thereof which are e.g. formed by stamping the edges of the first guide groove 11.

Figure 1:
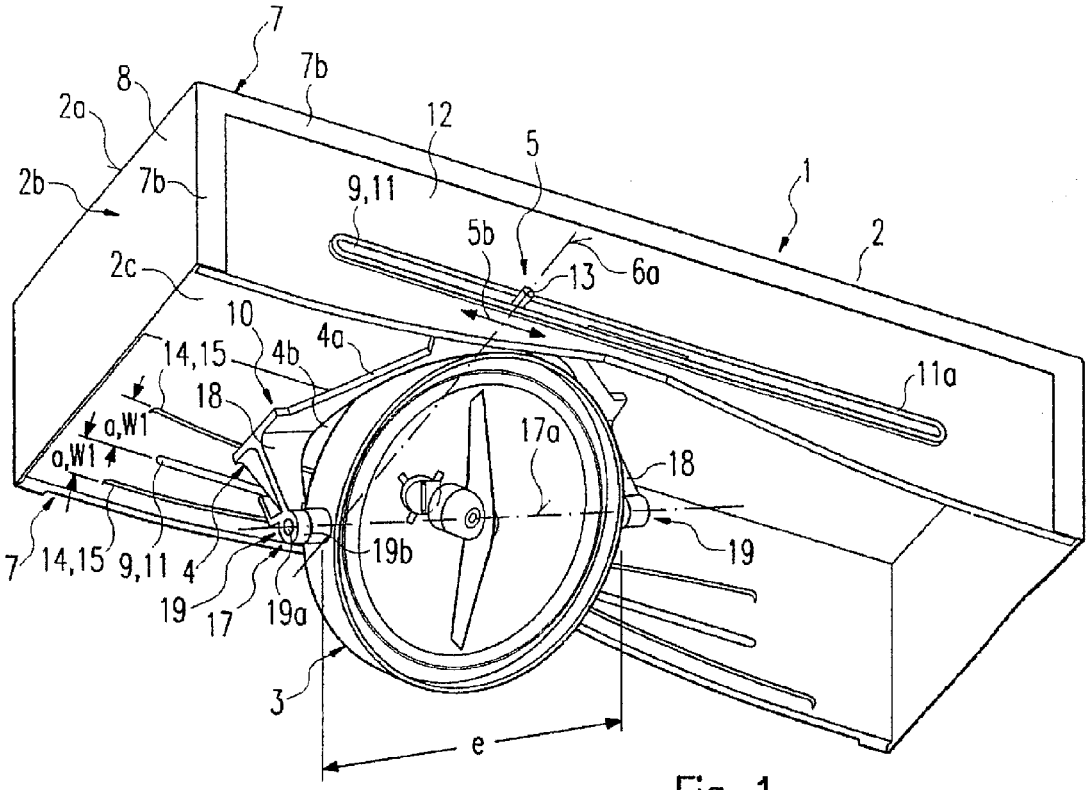
FIG. 1 a first exemplary embodiment of a luminaire according to the invention with a housing and an adjustable spotlight, in a perspective illustration from one side and below.
Figure 2:
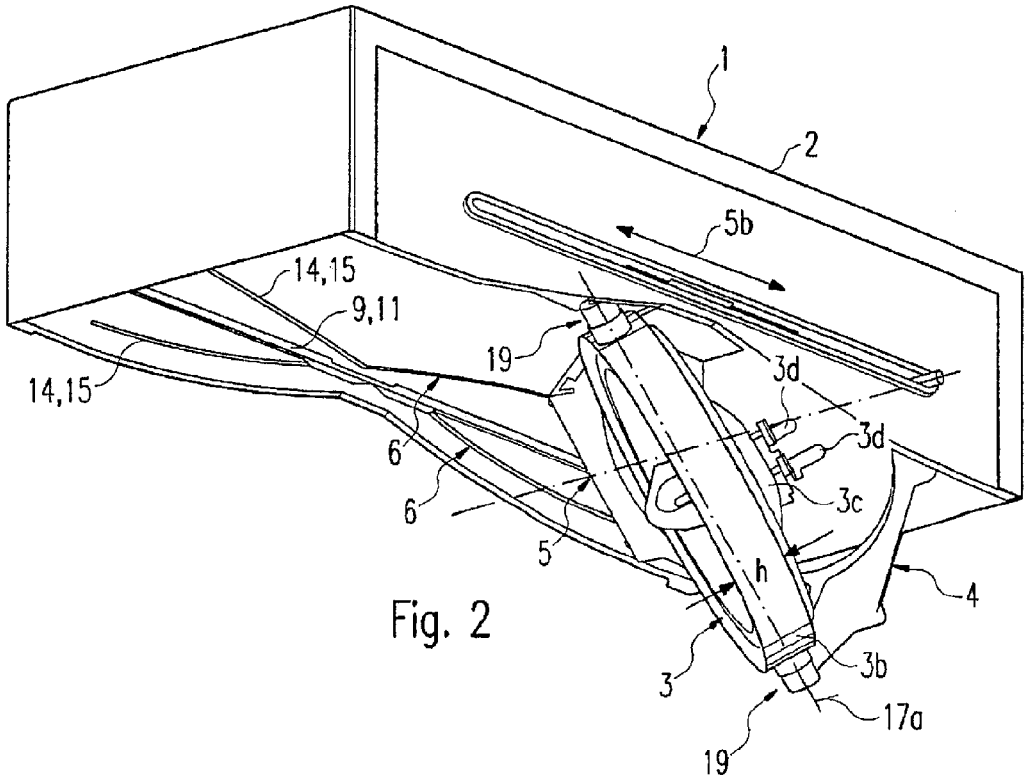
FIG. 2 the luminaire in a slightly rotated perspective and in another pivot position of the spotlight.
Figure 3:
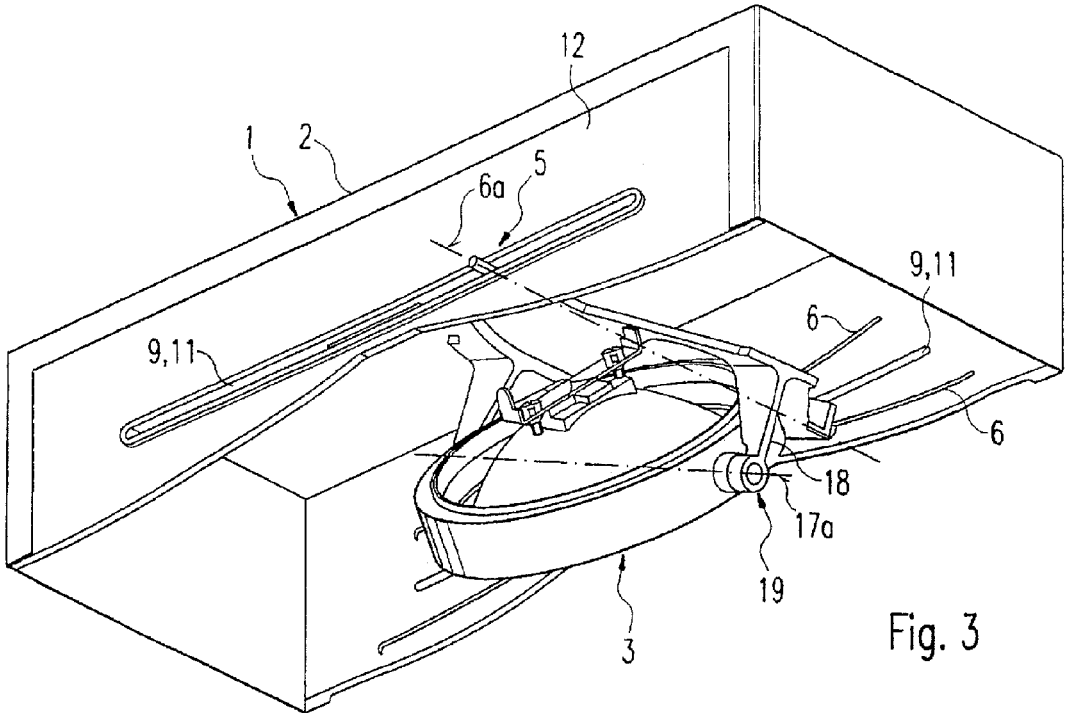
FIG. 3 the luminaire in another side perspective.

As can be recognized from FIGS. 1 to 3, the two guide walls 7 form the side walls 7, whereby of the actual side walls only edge strips 7*b* are present and connected with the neighbouring side walls 8 and the base wall of 2*a*, whereby the guide walls 12 bear on the inner side on the edge strips 7*b* and are fastened in a manner not illustrated, e.g. by gluing.

In that the guide walls 12 are per se separate components which are installed in construction, it is possible on the one hand to prefabricate the guide walls 12 in a simple manner as individual components and on the other hand to form them economically of a material of higher strength, e.g. higher wear resistance, to ensure a long working life.

The spotlight 3 has preferably a low construction height h which e.g. can be formed by a plate 3*b* given a concave form on the emission side, which can have on its side towards the luminaire housing 2 an outward bulging 3*c*. At the inner side, connection elements 3 for the electrical power supply are arranged, to which non-illustrated flexible electrical lines extend with such a length that the spotlight 3 can execute its displacement and pivot movements. The electrical lines extend e.g. through a line through-way into the interior of the luminaire housing 2 in which they can be fastened to the luminaire housing 2 in the area of the line through-way.

In order to be able in each case to position the spotlight 3 in its position pivoted around its pivot axis 17*a*, at least one suitable positioning means is provided that positions the spotlight 3 in the adjusted pivot position. This may be provided e.g. by a stiffness of at least one rotary bearing 19, which for pivoting and adjusting the spotlight 3 can be manually overcome.

Figure 8:
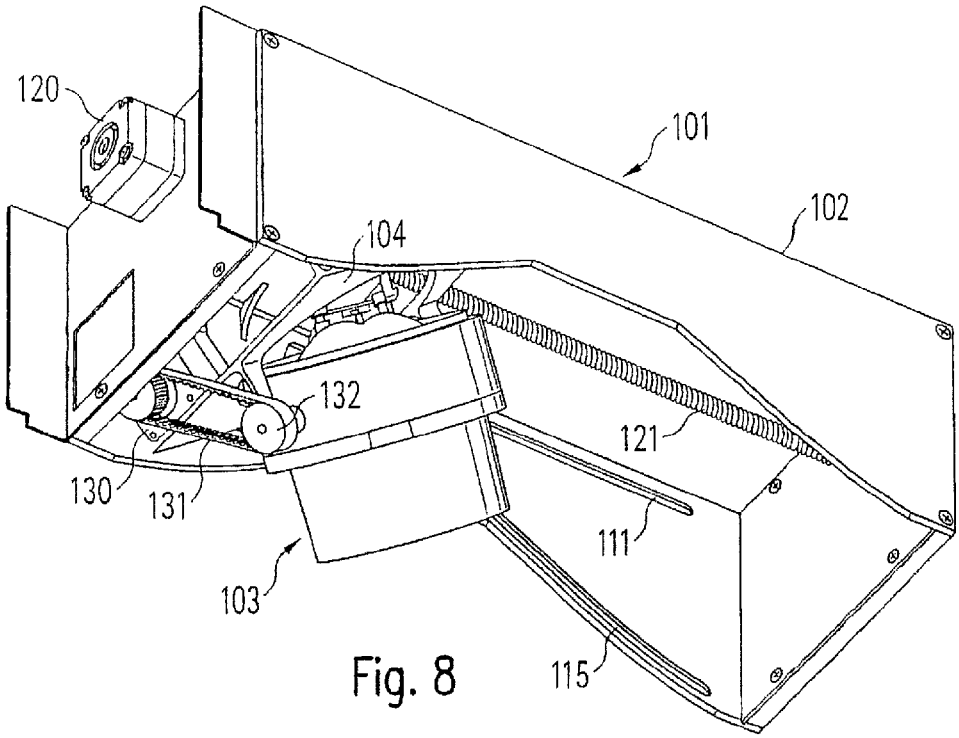
FIGS. 8 to 10 various views of a second exemplary embodiment of a luminaire according to the invention.
Figure 9:
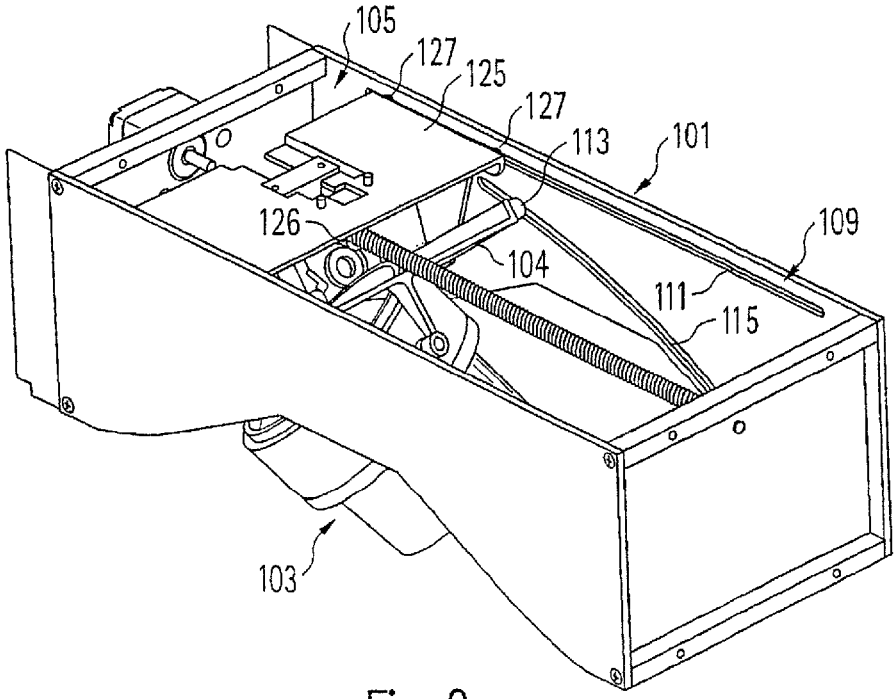
Figure 10:
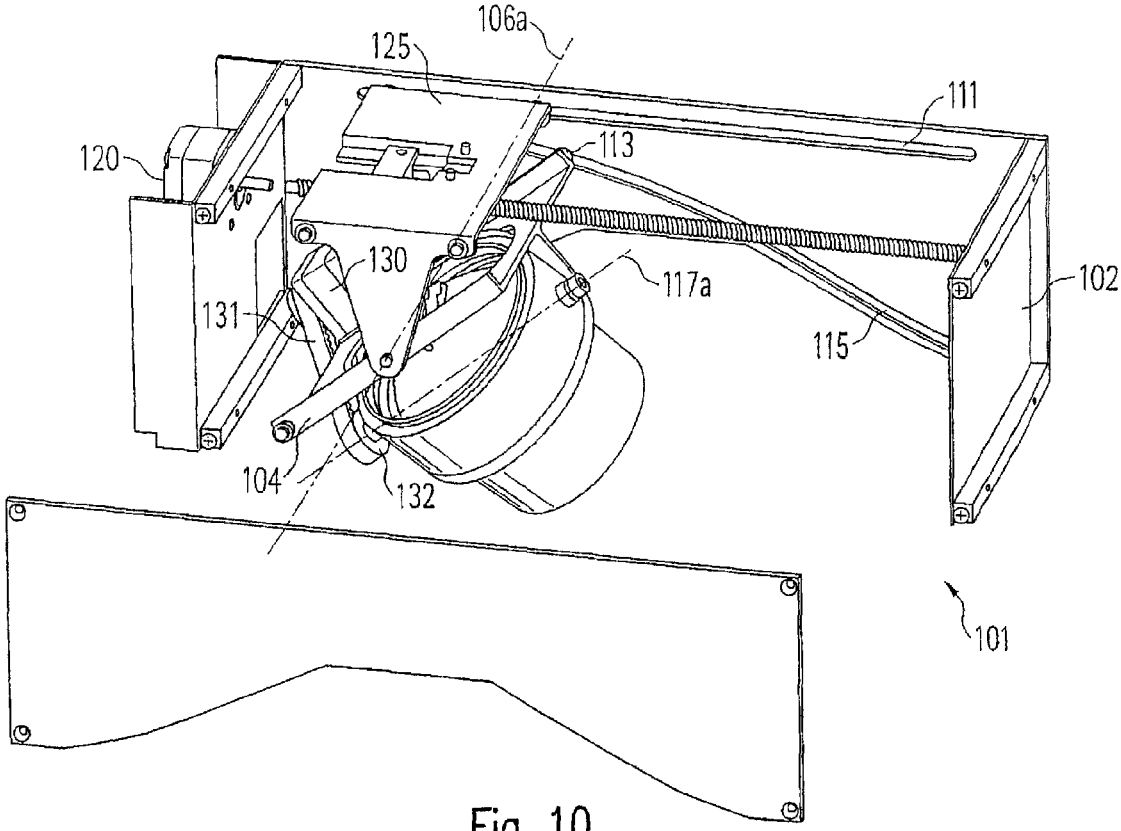

A second exemplary embodiment of a luminaire according to the invention is illustrated in FIGS. 8 to 10. Just like the first exemplary embodiment of FIGS. 1 to 7 this second exemplary embodiment of the luminaire, provided overall with the reference sign 101, has as main components a luminaire housing 102, a spotlight 103, a carrier 104 for the spotlight as well as a displacement mechanism 105 with the aid of which the carrier 104 is mounted within the housing 102 displaceable in a straight line in a displacement plane. In turn, the carrier 104 and the spotlight 103 form a spotlight arrangement 110. Furthermore the luminaire 101 is configured in turn such that a compulsory pivoting of the spotlight 103 takes place upon a displacement along the displacement direction.

A specific feature of the second exemplary embodiment consists that in the displacement of the spotlight 103 is not now manually effected but by means of a drive provided therefor. First, for this purpose, the luminaire 101 has a first electric motor, connected with a shaft 121 and drives this or sets it in rotation. The shaft 121 extending longitudinally through the luminaire housing 102 has an external thread which in turn cooperates with a corresponding internal thread of a guide sleeve 126 which is fastened to a guide slider 125. As can be understood in particular in the illustration in FIGS. 9 and 10, the guide slider 125 has end side pins 127 which engage into a guide groove 111 of a guide sleeve 109 of the luminaire housing 102. Depending on the direction in which the shaft 121 is rotated by the electric motor 120, the slider 125 is therefore moved in the one or other direction of the luminaire housing 102.

In turn, the simultaneous pivoting of the spotlight 103 during a longitudinal movement of the guide slider 125 is effected by means of another guide groove 115 which is provided at a side wall of the housing 102. Into this guide groove 115 there engages a pin 113 located on the carrier 104 and correspondingly forms, depending on position of the slider 125 within the luminaire housing 102, a bearing point for the carrier 104 of the spotlight 103. The carrier 104 itself is mounted pivotably on the slider 125 which consequently brings about that, upon a movement of the slider 125 in the one or other direction, the spotlight 103 fastened to the carrier 104 is also pivoted in a suitable manner.

In turn the guide groove 115 is configured such that the spotlight 103 can be pivoted between two maximum pivot settings which in each case correspond to a positioning of the spotlight 103 near the end faces of the luminaire housing 102, whereby at a middle position of the spotlight 103 in the housing 102 the spotlight 103 is directed vertically towards the underside.

By means of a suitable suspension of the spotlight 103 on the carrier 104 there is finally also made possible a pivoting around a second axis 117*a*, whereby an electrical drive is provided also for this. For this purpose the luminaire 101 has another electric motor 130 which is attached to the carrier 104 and is connected via a toothed belt 131 with a gear wheel 132 fixedly attached with the second pivot axis 117*a* of the spotlight 103. Thus the second electric motor 130 permits pivoting of the spotlight 103 in a desired way around the second pivot axis 117*a*.

As also with the first exemplary embodiment the advantage according to the invention is provided that the luminaire 101 has a relatively low structural height, since the pivoting of the spotlight 103 around the first pivot axis 106*a* is afforded by a special pivoting mechanism which converts a straight-line movement of the carrier 104 into a pivot movement of the spotlight 103. The use of the electric motors 120, 130 allows now, however, a remotely controlled adjusting of the spotlight position to be effected. This is particularly of advantage in such application cases in which the luminaire 101 is accessible only with difficulty due to its arrangement. For example in rooms in which the ceiling has a high distance from the ground a comfortable adjusting of the spotlight position is possible through this.

Figure 11A:
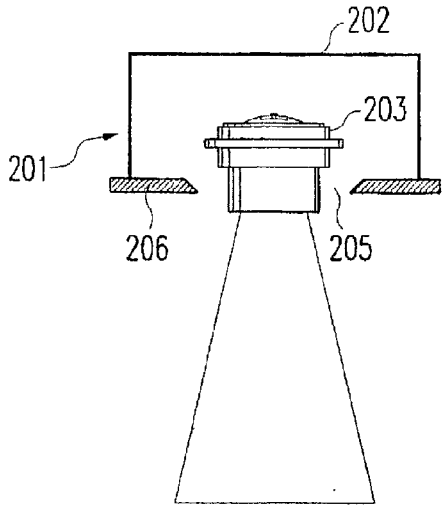
FIGS. 11*a*, 11*b* light emission with a luminaire having a pivotable spotlight in accordance with the state of the art.
Figure 11B:
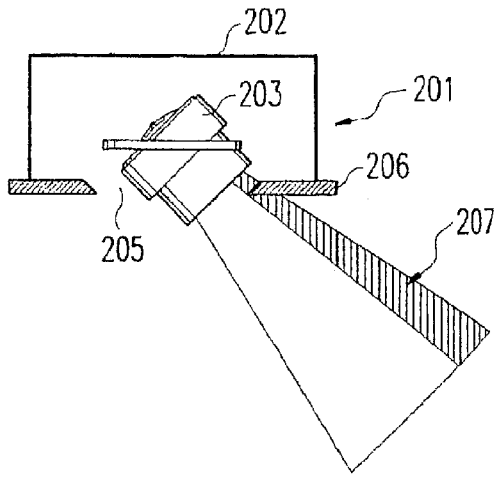

A particular advantage of the present invention can be clarified again with reference to FIGS. 11 to 14. FIGS. 11*a* and 11*b* thereby first show a spotlight luminaire 201 configured conventionally in which the behaviour is illustrated in case that the spotlight 203 is directed vertically to the underside (FIG. 11*a*), and for the case the spotlight 203 is pivoted around an axis. With the luminaire 201 illustrated in FIGS. 11*a* and 11*b*, the spotlight 203 is thereby so mounted within the housing 202 such that it slightly projects with its front side beyond a middle emission opening 205 of the luminaire housing 202. A displacement parallel to the base surface of the housing, such as is provided with the present invention, is not possible with this known luminaire.

As can be understood from the illustration in FIG. 11*b*, pivoting of the spotlight 203 in a lateral direction brings about that a part 207 of the light emitted by the spotlight 203 is blocked by the lower cover 206 of the luminaire housing 202. In the illustrated example this can lead to light losses of 25%.

Figure 12A:
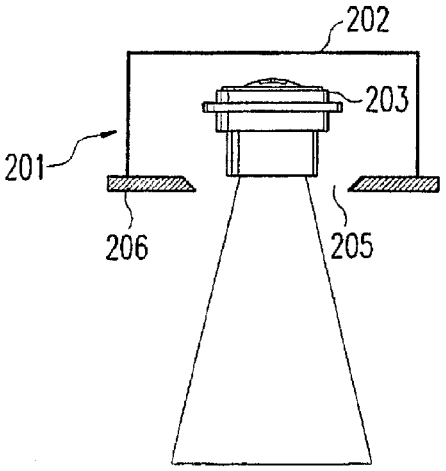
FIGS. 12*a*, 12*b* light emission with another luminaire having a pivotable spotlight in accordance with the state of the art.
Figure 12B:
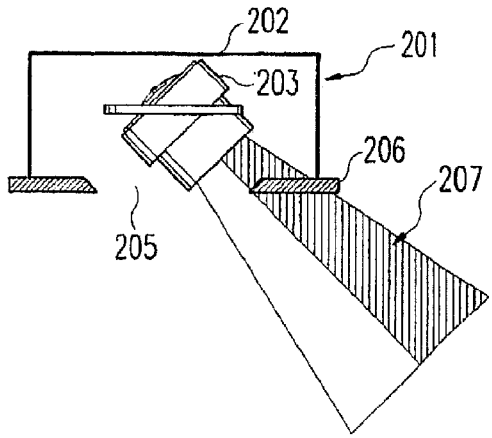
Figure 13A:
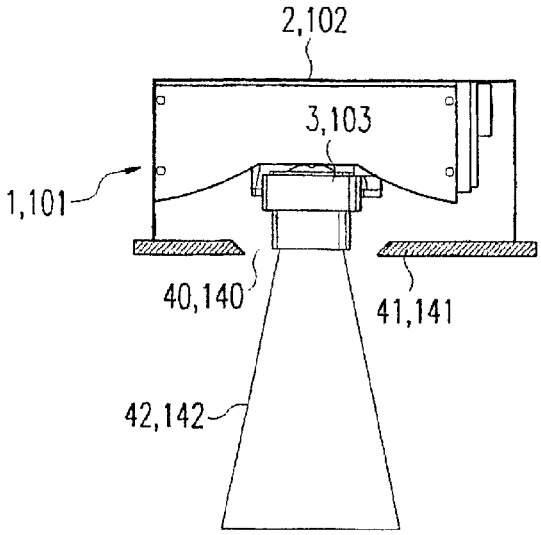
FIGS. 13*a*, 13*b* an illustration corresponding to FIGS. 11*a*, 11*b* and 12*a*, 12*b* with a luminaire according to the invention and FIGS. 14*a*, 14*b* perspective views of the illustrations in FIGS. 13*a*, 13*b*.
Figure 13B:
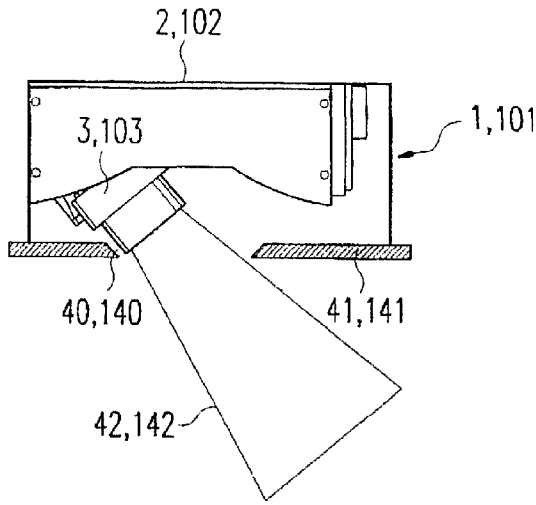
Figure 14A:
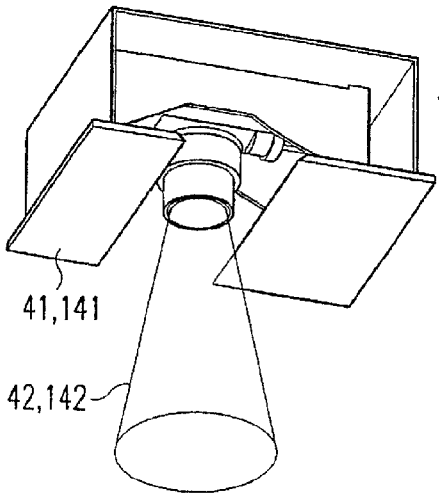
Figure 14B:
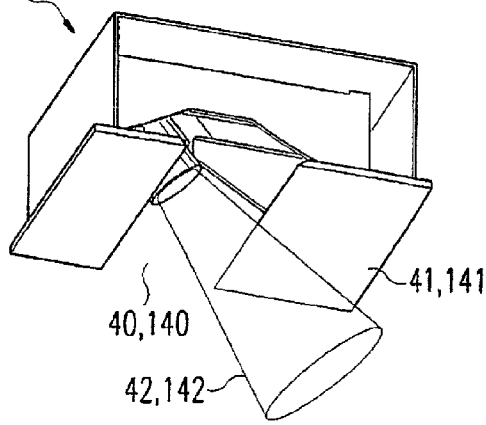

If the spotlight is mounted inside the luminaire housing further upwardly so that it does not project over the emission opening of the housing, the light losses appearing upon pivoting the spotlight are even greater, as the illustrations of the FIGS. 12*a* and 12*b* show. In this case the arrangement of the spotlight with reference to the lower cover of the luminaire housing is even more unfavourable, so that a large component of the emitted light is blocked (up to 50%).

With the spotlight luminaire 1, 101 according to the invention it is made possible it by the combination according to the invention of displacement and pivoting of the spotlight 3, 103, however, that the spotlight 3, 103 is always directed in the same way at a middle emission opening 40, 140, which is formed in a lower cover 41, 141 of the housing 2, 102. In particular from the sectional views of FIGS. 13*a* and 13*b* it can be understood that even in pivoted state of FIG. 13*b* the spotlight 3, 103 is so oriented that the cone of light 42, 142 coming therefrom can completely emitted through the emission opening 40, 140 of the luminaire housing 2, 102. This represents a clear advantage over classic spotlight luminaires since now multiple possibilities for the orientation of the spotlight 3, 103 arise, without the danger that a light loss would arise.

Thus, by means of the present invention there is provided a spotlight luminaire which is distinguished through its multiple adjustment possibilities, which make possible at any time an optimized alignment of the spotlight. At the same time a flat structure of the luminaire is ensured since the corresponding alignment of the spotlight is brought about by the adjusting device configured accordingly to the invention. Finally, there is provided the possibility of carrying out the adjusting of the spotlight by remote control, through which the range of possible applications for the luminaire is further improved.

The invention claimed is:

1. A luminaire (1; 101) comprising a luminaire housing (2; 102) and an adjustable spotlight arrangement (10; 110), wherein the spotlight arrangement (10;

110) is held displaceably in a straight-line displacement direction (5*b*) of the luminaire housing (2; 102), and in that in the luminaire housing (2; 102) there is provided a pivot guide slot member (9; 109), by means of which upon displacement in the displacement direction (5*b*) the spotlight arrangement (10; 110) is compulsorily and reproducibly pivoted.

2. A luminaire according to claim 1, wherein the pivot guide slot member (9; 109) is formed by a pivot movement guide groove (15; 115) in a guide wall (12) and the spotlight arrangement (10; 110) is guided in the pivot movement guide groove (15; 115) with a pivot movement guide pin (16; 113) engaging into the pivot movement guide groove (15; 115).

3. A luminaire according to claim 2, wherein an X-form pivot guide slot member (14) is provided, into the lateral-with reference to the middle plane (E1)-guide groove branches of which the spotlight arrangement (10) engages with two pivot movement guide pins (16), wherein the pivot movement guide pins (16) arc movable in the region of the apex of the X-form upon further pivoting of the spotlight arrangement (10) in the same pivot movement direction, the pivot movement guide pins (16) are movable transversely to the displacement direction (5*b*) into the guide groove branches lying alternately opposite one another.

4. A luminaire according to claim 1, wherein in the displacement end positions the spotlight arrangement (10; 110) takes up, with reference to a middle plane (E1) extending transversely of the displacement direction (5*b*) and between the end positions, mutually opposite and in particular minor symmetrical pivot positions.

5. A luminaire according to claim 1, wherein the spotlight arrangement (10) is displaceably guided longitudinally of the displacement direction (5*b*) in a displacement guide slot member (9), which includes an acute angle (W1) with the pivot guide slot member (14) and/or runs in the apex of the X-form pivot movement guide slot member (13) and between the pivot movement guide groove branches.

6. A luminaire according to claim 5, wherein the displacement guide slot.member (14) is formed by a displacement guide groove (11) extending straight in the guide wall (12) and the carrier (4) engages with a displacement guide pin (13) into the displacement guide groove (11) and is guided therein.

7. A luminaire according to claim 6, wherein the width of the displacement guide groove (11) is smaller than the width of the pivot movement guide groove (15) and/or the depth of the displacement guide groove (11) is larger than the depth of the pivot movement guide groove (15).

8. A luminaire according to claim 1, wherein two guide walls (12) having a spacing from each other are provided in which in each case a pivot guide slot member (14) and also a displacement guide slot member (9) is or are arranged and between which the spotlight arrangement (10) is arranged.

9. A luminaire according to claim 1, wherein the guide walls (12) form oppositely lying side walls (7) of the luminaire housing (2).

10. A luminaire according to claim 1, wherein the Spotlight arrangement (10; 110) is comprised of a carrier (4; 104) and a spotlight (3; 103) mounted pivotably thereon in a pivoting mechanism and the carrier (4; 104) is mounted displaceably by means of the pivot guide slot member (14) and also by means of the displacement guide slot member (9)).

11. A luminaire according to claim 10, wherein the pivoting mechanism has a pivot axis (17*a*) approximately in the displacement plane (5*a*) or arranged at an acute angle thereto.

12. A luminaire according to claim 1, wherein the spotlight (3;

103), in each position along the displacement direction (5*b*), is directed at an emission opening (40, 140) of the luminaire housing (2; 102).

13. A luminaire according to claim 1, further comprising a drive for adjusting the spotlight arrangement (10; 110).

14. A luminaire according to claim 13, wherein the drive has an electric motor (120) which cooperates with a guide slider (125) via a shaft (121), to which guide slider the spotlight arrangement (10; 110) is pivotably fastened.

15. A luminaire according to claim 14, wherein a second electric motor (130) for pivoting the spotlight around a second pivot axis (117*a*).

16. A luminaire according to claim 13, wherein the drive for adjusting the spotlight arrangement (10; 110) is remotely controllable.

* * * * *